US012135196B2

(12) United States Patent
Thuman et al.

(10) Patent No.: US 12,135,196 B2
(45) Date of Patent: Nov. 5, 2024

(54) METHOD FOR PRODUCING A COMPONENT FOR A WARHEAD, AND WARHEAD

(71) Applicant: BAE SYSTEMS BOFORS AB, Karlskoga (SE)

(72) Inventors: Christer Thuman, Karlskoga (SE); Hamzah Hamdan, Karlskoga (SE); Björn Johansson, Karlskoga (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 70 days.

(21) Appl. No.: 17/802,185

(22) PCT Filed: Feb. 1, 2021

(86) PCT No.: PCT/SE2021/050072
§ 371 (c)(1),
(2) Date: Aug. 25, 2022

(87) PCT Pub. No.: WO2021/173053
PCT Pub. Date: Sep. 2, 2021

(65) Prior Publication Data

US 2023/0358519 A1 Nov. 9, 2023

(30) Foreign Application Priority Data

Feb. 28, 2020 (SE) ..... 2000045-1

(51) Int. Cl.
*F42B 33/00* (2006.01)
*F42B 12/24* (2006.01)
*F42B 12/32* (2006.01)

(52) U.S. Cl.
CPC ..... *F42B 33/001* (2013.01); *F42B 12/24* (2013.01); *F42B 12/32* (2013.01)

(58) Field of Classification Search
CPC ..... F42B 12/32; F42B 12/24; F42B 33/001
(Continued)

(56) References Cited

U.S. PATENT DOCUMENTS 3,815,504 A 6/1974 Tieben
4,032,335 A 6/1977 Zapf et al.
(Continued)

FOREIGN PATENT DOCUMENTS

DE 0012322 A1 * 12/1979 ..... F42B 12/32
DE 0012323 A1 * 12/1979 ..... F42B 12/32
(Continued)

OTHER PUBLICATIONS

International Search Report (May 10, 2021) for corresponding International App. PCT/SE2021/050072.
(Continued)

*Primary Examiner* — Jonathan C Weber
(74) *Attorney, Agent, or Firm* — WRB-IP PLLC

(57) ABSTRACT

A method is provided for producing a component for a warhead, wherein the method involves the steps: i.) an inner shell is arranged on a tool, ii.) preshaped projectiles are arranged on the inner shell, iii.) powder is arranged to enclose the preshaped projectiles, iv.) the powder is pressed such that the powder, the preshaped projectiles, and the inner shell are joined together, v.) the tool is removed from the component formed from the powder, the preshaped projectiles, and the inner shell. A warhead and a projectile are also provided.

7 Claims, 5 Drawing Sheets

(58) Field of Classification Search
USPC ..... 102/497
See application file for complete search history.

(56) References Cited

U.S. PATENT DOCUMENTS

| | | | | |
|---|---|---|---|---|
| 4,292,829 | A * | 10/1981 | Weber | B22F 7/08 72/76 |
| 4,644,867 | A | 2/1987 | Hellner et al. | |
| 7,614,348 | B2 * | 11/2009 | Truitt | F42B 12/32 102/497 |
| 10,712,137 | B1 * | 7/2020 | McGowan | F42B 33/001 |
| 11,041,704 | B1 * | 6/2021 | Ellis | B22F 7/08 |
| 2009/0211484 | A1 * | 8/2009 | Truitt | F42B 12/50 102/497 |
| 2014/0020590 | A1 * | 1/2014 | Torsten | F42B 33/00 102/495 |
| 2016/0258727 | A1 * | 9/2016 | Bruno | F42B 12/24 |

FOREIGN PATENT DOCUMENTS

| | | | | |
|---|---|---|---|---|
| NL | 7908682 | A * | 6/1980 | F42B 12/32 |
| SE | 416678 | B | 1/1981 | |
| SE | 0200163 | A1 | 9/2013 | |
| WO | 2017120684 | A1 | 7/2017 | |
| WO | 2019112502 | A1 | 6/2019 | |
| WO | WO-2020190192 | A1 * | 9/2020 | B22F 10/30 |

OTHER PUBLICATIONS

European Search Report (Feb. 1, 2024) for corresponding European App. EP 21 76 1359.

* cited by examiner

METHOD FOR PRODUCING A COMPONENT FOR A WARHEAD, AND WARHEAD

BACKGROUND AND SUMMARY

The present invention relates to a method for producing a warhead, such as a projectile, wherein the method involves the joining together of powder, preshaped projectiles, and an inner shell, preferably by using the HIP, or Hot Isostatic Pressing, manufacturing method. The invention also relates to a projectile produced by the method.

The arranging of preshaped fragments/splinters/projectiles in warheads has long been known. By selecting the type of preshaped projectiles that is used, the effect can be adapted to the target. Based on the type of target that is being assaulted, one can determine, for example, the number of preshaped projectiles, the size of the preshaped projectiles, the material in the preshaped projectiles, and the shape of the preshaped projectiles. When the warhead bursts, the preshaped projectiles or the preshaped fragments are dispersed with a predetermined size and mass. It is also possible to influence the direction in which the preshaped projectiles will be dispersed.

Another way of creating projectiles with a predetermined size and mass which is known to the person skilled in the art, besides the arrangement of preshaped projectiles, is to create controlled fragmentation of the warhead. This basically involves the creating of weakened points in the warhead, for example by machining grooves into its material, so that a dividing up of the warhead occurs more readily along these weakened points upon bursting/detonation.

It is also known how to combine the arrangement of preshaped projectiles with controlled fragmentation in the same warhead.

A rubber fixture is often used during part of the manufacturing process for the arranging of the preshaped projectiles. The producing of rubber fixtures is in itself a relatively costly and labor-demanding process. The flexibility in producing a new product or adapting/modifying an existing product is likewise limited, since new shapes and geometries require a new rubber shaping tool, which means long lead times and development work, and thus high costs. Accordingly, it is often difficult and time-consuming to create a controlled fragmentation by milling of grooves in the warhead material.

An example of manufacturing methods for warheads having preshaped projectiles is given in the U.S. Pat. No. 3,815,504, which shows a manufacturing method for warheads/projectiles and the warhead/projectile manufactured by coaxially positioning two tube-shaped bodies one around the other with a spacing corresponding to the diameter of the contained splinters/fragments/balls which are arranged between the two tube-shaped bodies. A pressure from the inside forms the tube-shaped bodies around the splinters/fragments/balls when the arrangement is situated with an anvil on the outside.

An alternative example of a manufacturing method with preshaped projectiles is given in the U.S. Pat. No. 4,032,335, which shows a process for producing a composite material consisting of metal powder with fragments/preshaped projectiles arranged together against a metal structure. By subjecting the composite to an isostatic compressing force, the metal powder is caused to be embedded in the surrounding metal.

A common feature of the above prior art is that the material may have pores and a low value of impact toughness and elongation upon rupture, which in turn may cause problems in regard to strength and gas tightness. Further, the above prior art involves manufacturing problems such as the number of steps in the process and/or machining methods, such as cutting machining, and material consumption.

It is desirable to create an easier, faster, and more cost-effective way of producing a warhead having preshaped projectiles and/or a controlled fragmentation.

The invention relates, according to an aspect thereof, to a method for producing a component for a warhead, wherein the method involves the steps:

i.) an inner shell is arranged on a tool, ii.) preshaped projectiles are arranged on the inner shell, iii.) powder is arranged to enclose the preshaped projectiles, iv.) the powder is pressed such that the powder, the preshaped projectiles, and the inner shell are joined together, v.) the tool is removed from the component formed from the powder, the preshaped projectiles, and the inner shell.

According to further aspects for a method for producing a component for a warhead:

- the powder is pressed by means of high pressure and heat, also known as Hot Isostatic Pressing (HIP).
- the powder, the preshaped projectiles, and the inner shell are arranged together in a suitably adapted HIP-container.
- the inner shell is a casing for a grenade body.
- the inner shell is a spacer material.
- the preshaped projectiles are arranged in an enclosing network.
- the network is formed with meshes to retain the preshaped projectiles when the network is arranged around the preshaped projectiles arranged on the inner shell.

The invention further relates to a warhead produced by a method according to the above.

The invention further relates to a warhead comprising a projectile.

By producing the warheads/projectiles with HIP, or Hot Isostatic Pressing, the warheads can be produced with better performance than in the prior art. Improvements relate to homogeneous warheads with no pores and thus better control of performance, fewer steps in the method and thus lower manufacturing costs, and less material consumption thanks to reducing the need for machining of each warhead so produced.

BRIEF DESCRIPTION OF THE DRAWINGS

The invention shall be described more closely in the following with reference to the enclosed figures, where.

DETAILED DESCRIPTION

The present invention shows an embodiment of a manufacturing method for components for warheads, such as projectiles and grenades, by the use of hot isostatic pressing. Hot isostatic pressing, also known as HIP, is a manufacturing process which is employed to eliminate or diminish the internal porosity of cast metal pieces and other material. HIP also makes possible a packing of metal, polymer, ceramic and composite powder in solid form. The benefits include the removing of all internal cavities in the metal components created by manufacturing methods and the improving of mechanical properties such as fatigue resistance/fatigue strength, toughness, plasticity, and impact strength. Moreover, HIP can create a tight material from metal, composite, polymer, or ceramic powder without melting.

By using HIP, a solid material can be created from powder with superior properties where the powder/powder components have a fine, uniform grain size and an isotropic structure. Moreover, thanks to the use of HIP, different metals can be joined without the need for temperature-limiting binding materials. With HIP, one can create multiple diffusion bonds in a single process cycle. A great number of metal alloys, as well as many composites, polymers and ceramics, can undergo HIP. This includes, among others, alloys with nickel, cobalt, tungsten, titanium, molybdenum, aluminum, copper and iron, oxide and nitride ceramics, glass, intermetallides, and premium plastics.

Figure 1A:
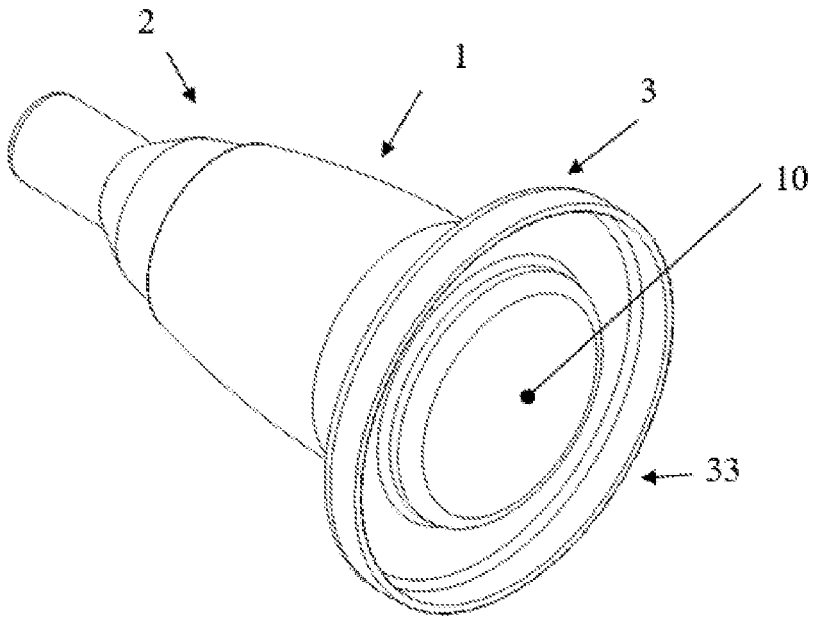
FIG. 1*a* shows a perspective view of an inner shell for a warhead arranged on a tool according to the invention, in a first embodiment of the invention.

FIG. 1*a* shows an inner shell 1 for a warhead according to a first embodiment of the invention, where the inner shell is formed as a spacer material, also known as a liner. The warhead is an arrangement adapted to assault a target and it may consist of or comprise a projectile, such as a grenade, or it may be a component in a projectile such as a grenade. The inner shell 1 is hollow, to enable the arrangement of an explosive therein. The inner shell 1 is also configured to receive a nose portion and an aft portion in its front 2 and rear 3 end, respectively. The nose portion and the aft portion may have a number of different configurations, depending on the desired properties of the warhead, but since they are not part of the present invention they are not shown in the drawings. The inner shell 1 is preferably made of a material which the person skilled in the art will consider to be appropriate to its purpose, usually a metal material, but it may also be a plastic or a composite, and many examples of the material are already known in the art. A tool 10 is arranged inside the inner shell 1, the tool being made preferably of homogeneous steel and being configured to handle high pressure and/or high temperature. In the case when the inner shell 1 is a spacer material, the spacer material thus acts like a driving mirror for projectiles. The bottom plate 33 of the HIP-container is also shown in the figure.

Figure 1B:
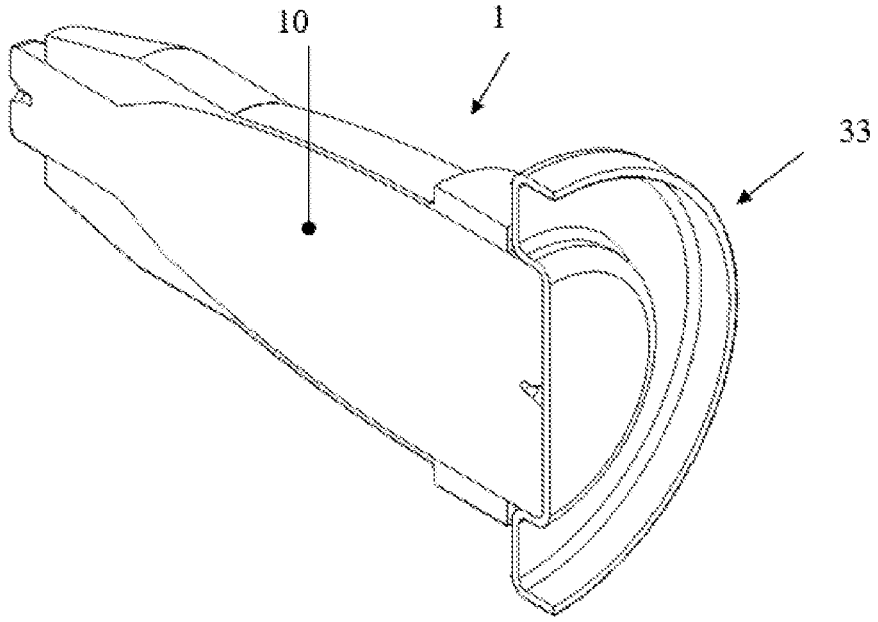
FIG. 1*b* shows a perspective view of an inner shell for a warhead and the inner shell arranged on a tool according to the invention, in a second embodiment of the invention.

FIG. 1*b* shows an alternative embodiment, where the inner shell 1 is configured as a grenade body, preferably made of machined metal, such as by conventional lathe work, or by additive manufacturing methods. Indications of where the projectiles will be arranged are made in the inner shell 1. The bottom plate 33 of the HIP-container is also shown in the figure.

Figure 2A:
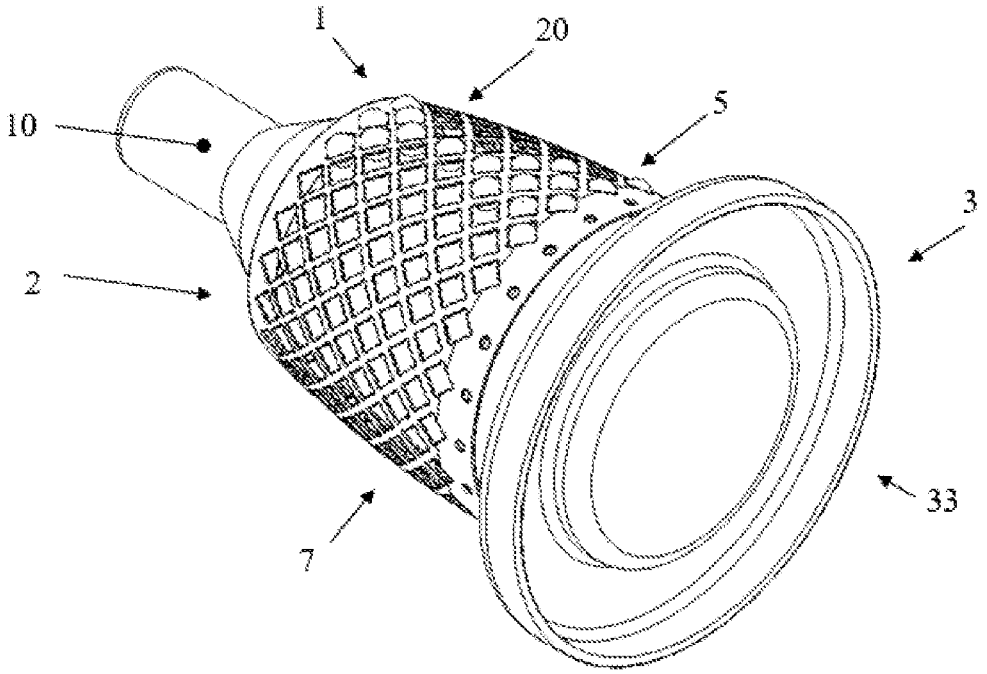
FIG. 2*a* shows a perspective view of the inner shell of FIG. 1*a*, on which an enclosing network is arranged, containing the preshaped projectiles, in a first embodiment of the invention.

FIG. 2*a* shows one step in the manufacturing of a warhead 4 according to the invention. A network 5, comprising preshaped projectiles 20, is arranged around the inner shell 1, preferably so as to enclose the inner shell 1 in the circumferential direction. The network 5 stretches along a portion of the inner shell 1 in the axial direction, but in the preferred embodiment the front end 2 and the rear end 3 are left free for connection to the respective nose and aft portions. The network 5 in the embodiment shown has meshes 7 adapted to receive the shape of the preshaped projectiles 20. The size and shape of the meshes 7 vary somewhat in the axial direction of the warhead 4, in order to connect to the shape of the inner shell 1 with a radius varying somewhat in the axial direction. The shape of the meshes 7 may vary within certain limits, as can their size, and they are adapted to the size and shape of the preshaped projectiles 20. The preshaped projectiles 20 may also be called fragments and/or splinters. In the configuration shown in FIG. 2*a*, the preshaped projectiles are ball-shaped or spherical. The network 5 is designed to produce the intended retention of the projectiles, where the shape and size of the meshes 7 prevent the projectiles from passing through them. In the case when the preshaped projectiles 20 are ball-shaped, the meshes 7 may be configured, for example, in complete or partial circular shape, to ensure a secure retention of the preshaped projectiles 20 when the preshaped projectiles 20 are arranged against the inner shell 1 and enclosed by the network 5, which is shown in the embodiment of FIG. 2*a*. The material used to produce the network 5 is preferably a metal material, but it may also be a plastic or ceramic which is chosen to have properties, such as thermal properties or melting point, a brittleness after heat treatment, and an ability to form alloys with other material. The network can be made from a plate which is punched or otherwise machined to give it a suitable configuration. The network can be rolled or pressed into a shape suitable for an arrangement enclosing the inner shell 1 and the preshaped projectiles 20.

One conceivable manufacturing method for the network 5 is to create a hole with the desired size in a plate, such as by punching, etching, laser cutting or some other production method which the skilled person considers to be suitable. The network shown is especially suitable for retention of preshaped projectiles having a cross section which is somewhat larger than the size of the meshes 7. The arranging of a number of preshaped projectiles 20 in the warhead is thus accomplished with the help of a network 5, which is either a standard product or which can be manufactured in a relatively easy and cost-effective manufacturing method. The network 5 does not need to be removed, but instead remains an integrated part of the warhead 4, which significantly simplifies the manufacturing process. In an alternative embodiment, the network 5 may also contribute to a controlled fragmentation of the warhead 4 in a way that enables a cost-effective production of the warhead 4. The bottom plate 33 of the HIP-container is also shown in the figure.

Figure 2B:
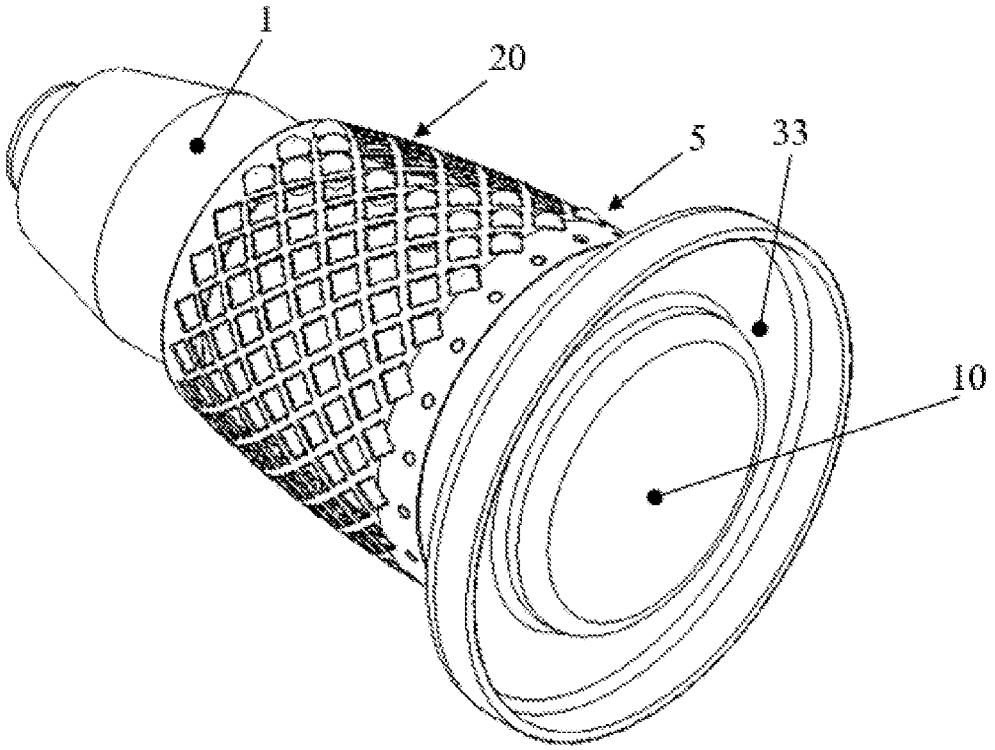
FIG. 2*b* shows a perspective view of the inner shell of FIG. 1*b*, on which an enclosing network is arranged, containing the preshaped projectiles, in a second embodiment of the invention.

FIG. 2*b* shows one step in the manufacturing of a warhead 4 according to a second, alternative embodiment of the invention, where the inner shell 1 is configured as a grenade body. A network 5, comprising preshaped projectiles 20, is arranged around the inner shell 1, preferably so as to enclose the inner shell 1 in the circumferential direction. The network 5 stretches along a portion of the inner shell 1 in the axial direction, but in the preferred embodiment the front end 2 and the rear end 3 are left free for connection to the respective nose and aft portions. The network 5 in the embodiment shown has meshes 7 adapted to receive the shape of the preshaped projectiles 20. The size and shape of the meshes 7 vary somewhat in the axial direction of the warhead 4, in order to connect to the shape of the inner shell 1 with a radius varying somewhat in the axial direction. The shape of the meshes 7 may vary within certain limits, as can their size, and they are adapted to the size and shape of the preshaped projectiles 20. The preshaped projectiles 20 may also be called fragments and/or splinters. In the configuration shown in FIG. 2*b*, the preshaped projectiles are ball-shaped or spherical. The network 5 is designed to produce the intended retention of the projectiles, where the shape and size of the meshes 7 prevent the projectiles from passing through them. In the case when the preshaped projectiles 20 are ball-shaped, the meshes 7 may be configured, for example, in complete or partial circular shape, to ensure a secure retention of the preshaped projectiles 20 when the preshaped projectiles 20 are arranged against the inner shell 1 and enclosed by the network 5, which is shown in the embodiment of FIG. 2*b*. The material used to produce the network 5 is preferably a metal material, but it may also be a plastic or ceramic which is chosen to have properties, such as thermal properties or melting point, a brittleness after heat treatment, and an ability to form alloys with other material. The network can be made from a plate which is punched or otherwise machined to give it a suitable configuration. The network can be rolled or pressed into a shape suitable for an arrangement enclosing the inner shell 1 and the preshaped projectiles 20. The bottom plate 33 of the HIP-container is also shown in the figure.

Figure 3A:
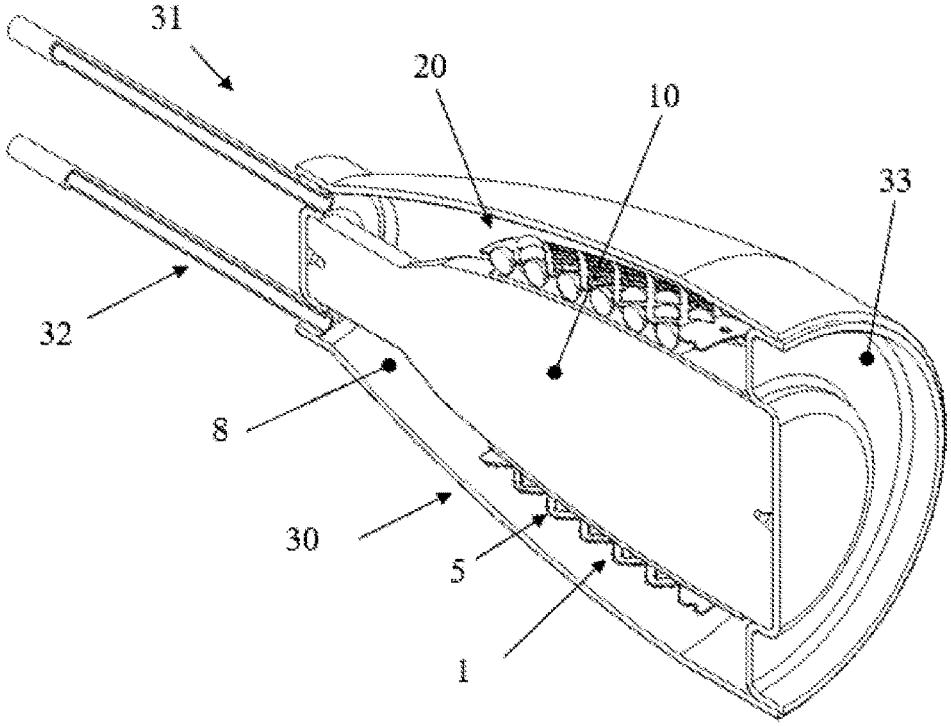
FIG. 3*a* shows a perspective view of a warhead arranged with powder prior to the HIP treatment, in a first embodiment of the invention.

FIG. 3*a* shows the warhead 4 in a manufacturing step according to a first embodiment of the invention. An applied material 8 has been placed on top of the network 5 arranged on the inner shell 1 as shown in FIG. 2*a* and the preshaped projectiles 20. FIG. 2*a* shows an inner shell 1 in the form of a spacer material. The application method is preferably some type of additive manufacturing method, where the material can be applied in powder form inside a HIP-container 30, which is a surrounding component arranged to retain the inner shell 1, arranged on the tool 10, where preshaped projectiles 20 enclosed by a network 5 are arranged on the inner shell and where powder in the form of applied material 8 is freely arranged in the HIP-container 30 enclosing the inner shell 1, the tool 10, the preshaped projectiles 20 and the network 5. By continued treatment in accordance with HIP, the powder is fixed in the intended place for the production of a warhead 4. Manufacturing methods involving powder have advantages in tight production conditions when the material being supplied has to get into spaces with small dimensions. The temperatures applicable in accordance with HIP for the applied material 8 also mean that the material in the underlying network 5 is affected. With a suitable material choice for both the material in the network 5 and that in the applied material 8, the material in the network 5 remains brittle due to diffusion and/or partial melting, or it forms an alloy with the applied material 8. The HIP-container 30 is arranged with a connection device 31, 32 for evacuation of air and vacuum pumping before and/or during the course of the manufacturing method, and a bottom plate 33.

In one embodiment, the material in the network 5 and the applied material, or the powder 8, are chosen such that the applied material 8 and the network 5 together form a homogeneous whole with non-existent, controlled, or limited material variation in the portion of the resulting warhead 4 constituted by the applied material 8 and the network 5.

In an alternative embodiment, the network 5 and the applied material 8 do not affect each other's physical properties more than that the layer of the applied material 8 becomes thinner on top of the material making up the network 5.

In a further alternative embodiment, the constituent materials and the temperatures during the material application are chosen such that the result is that the applied material 8 and the network 5 together form a whole which, depending on the choice of material, contains weakened areas where the network 5 was originally placed. The weakened areas in the whole formed by the applied material 8 and the network 5 will act as a controlled fragmentation upon bursting of the warhead 4. In an alternative embodiment, the portion of the applied material 8 which is arranged in the meshes 7 of the network 5 will form projectiles. This aspect will also be considered in the preferred embodiment when selecting the applied material 8, so that the projectiles formed in this way have a suitable mass, and when selecting the size and shape of the meshes, so that the projectiles formed in this way have a suitable size and shape and can interact with the preshaped projectiles 20 to achieve the maximum effect.

Figure 3B:
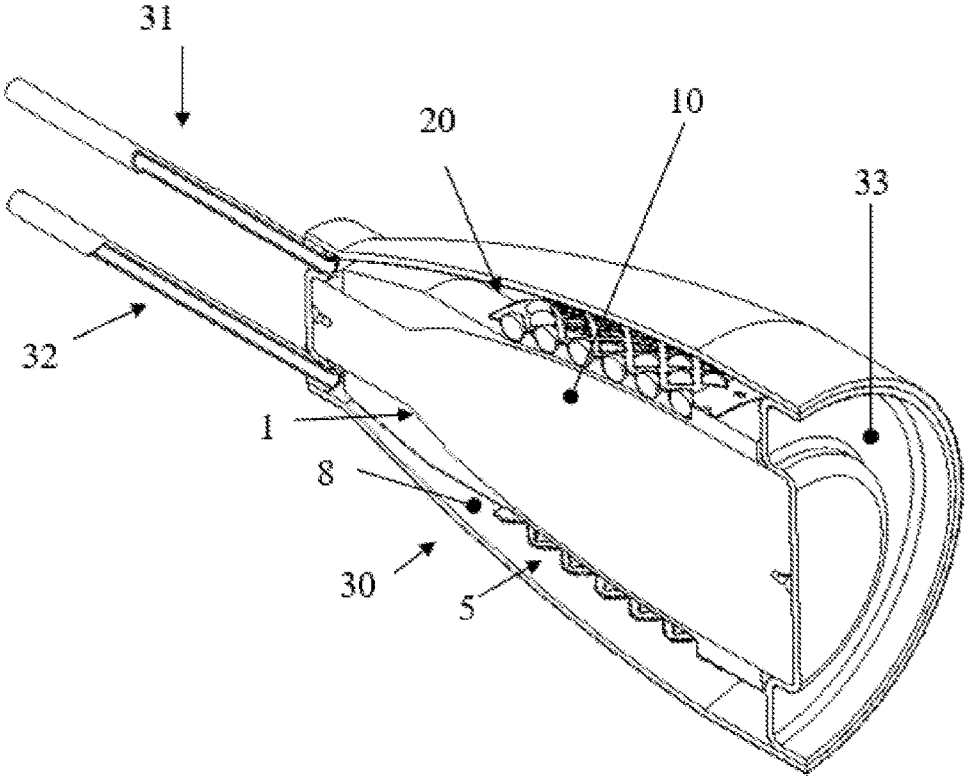
FIG. 3*b* shows a perspective view of a warhead arranged with powder prior to the HIP treatment, in a second embodiment of the invention.

FIG. 3*b* shows the warhead 4 in a manufacturing step according to a second, alternative embodiment of the invention. An applied material 8 has been placed on top of the network 5 arranged on the inner shell 1 as shown in FIG. 2*b* and the preshaped projectiles 20. FIG. 3*b* shows an inner shell 1 in the form of a grenade body. The application method is preferably some type of additive manufacturing method, where the material can be applied in powder form inside a HIP-container 30, which is a surrounding component arranged to retain the inner shell 1, arranged on the tool 10, where preshaped projectiles 20 enclosed by a network 5 are arranged on the inner shell and where powder in the form of applied material 8 is freely arranged in the HIP-container 30 enclosing the inner shell 1, the tool 10, the preshaped projectiles 20 and the network 5. By continued treatment in accordance with HIP, the powder is fixed in the intended place for the production of a warhead 4. Manufacturing methods involving powder have advantages in tight production conditions when the material being supplied has to get into spaces with small dimensions. The temperatures applicable in accordance with HIP for the applied material 8 also mean that the material in the underlying network 5 is affected. With a suitable material choice for both the material in the network 5 and that in the applied material 8, the material in the network 5 remains brittle due to diffusion and/or partial melting, or it forms an alloy with the applied material 8. The HIP-container 30 is arranged with a connection device 31, 32 for evacuation of air and vacuum pumping before and/or during the course of the manufacturing method, and a bottom plate 33.

In one embodiment, the material in the network 5 and the applied material, or the powder 8, are chosen such that the applied material 8 and the network 5 together form a whole with controlled material variation in the portion of the resulting warhead 4 constituted by the applied material 8 and the network 5.

In an alternative embodiment, the network 5 and the applied material 8 do not affect each other's physical properties more than that the layer of the applied material 8 becomes thinner on top of the material making up the network 5.

In a further alternative embodiment, the constituent materials and the temperatures during the material application are chosen such that the result is that the applied material 8 and the network 5 together form a whole which, depending on the choice of material, contains weakened areas where the network 5 was originally placed. The weakened areas in the whole formed by the applied material 8 and the network 5 will act as a controlled fragmentation upon bursting of the warhead 4. In an alternative embodiment, the portion of the applied material 8 which is arranged in the meshes 7 of the network 5 will form projectiles. This aspect will also be considered in the preferred embodiment when selecting the applied material 8, so that the projectiles formed in this way have a suitable mass, and when selecting the pattern, size and shape of the meshes, so that the projectiles formed in this way have a suitable size, shape, and dispersal and can interact with the preshaped projectiles 20 to achieve the maximum effect.

Figure 4A:
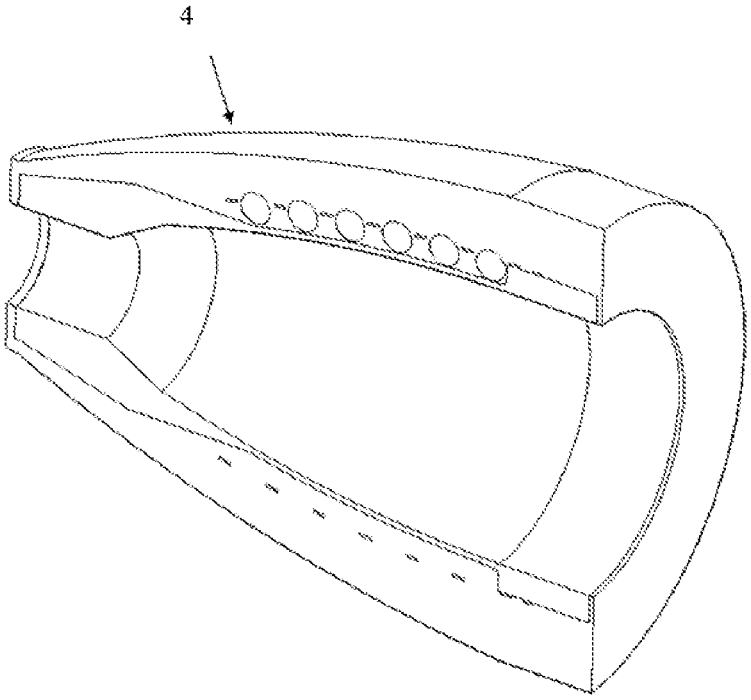
FIG. 4*a* shows a warhead manufactured according to the proposed method after going through all of the steps of the process, in a first embodiment of the invention.

FIG. 4*a* shows a casing for a warhead 4 manufactured according to the first embodiment after a production step of Hot Isostatic Pressing has been performed, the tool 10 has been removed from the inner shell 1, and the HIP-container has been machined away, for example, with a cutting type machining. The warhead 4 can now be called a HIPPED body and it can be finished to form a complete warhead 4, which can then be used as a component for manufacturing of projectiles, such as grenades.

Figure 4B:
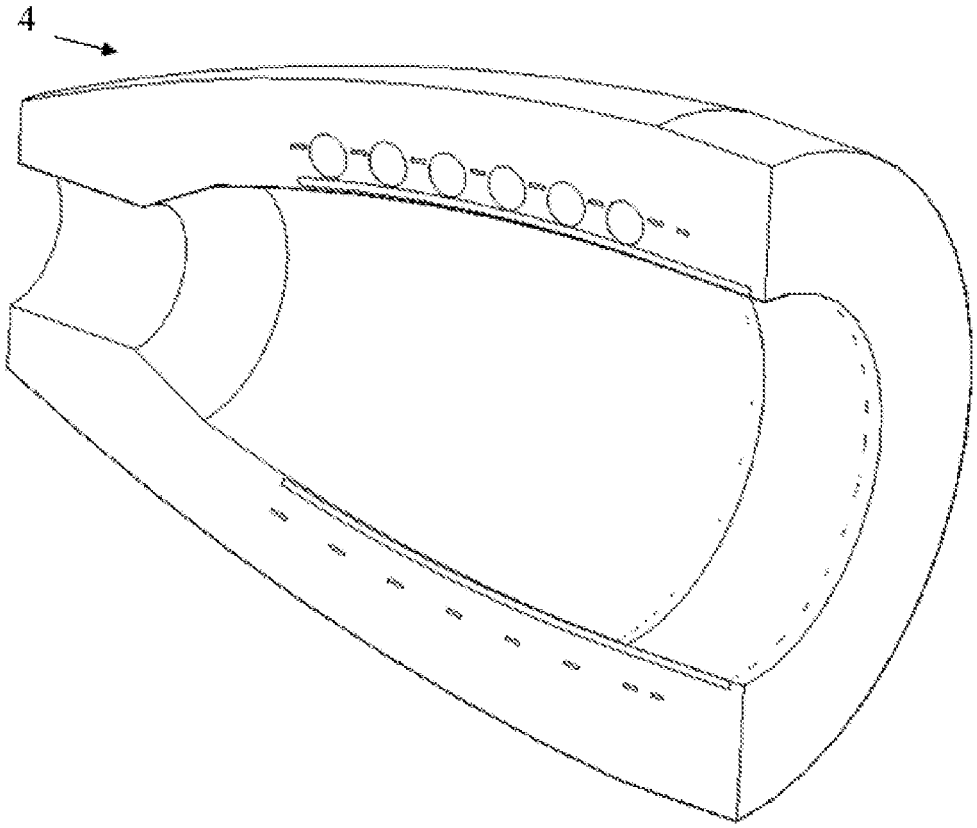
FIG. 4*b* shows a warhead manufactured according to the proposed method after going through all of the steps of the process, in a second embodiment of the invention.

FIG. 4*b* shows a casing for a warhead 4 manufactured according to the second embodiment after a production step of Hot Isostatic Pressing has been performed, the tool 10 has been removed from the inner shell 1, and the HIP-container has been machined away, for example, with a cutting type machining. The warhead 4 can now be called a HIPPED body and it can be finished to form a complete warhead 4, which can then be used as a component for manufacturing of projectiles, such as grenades.

Figure 5:
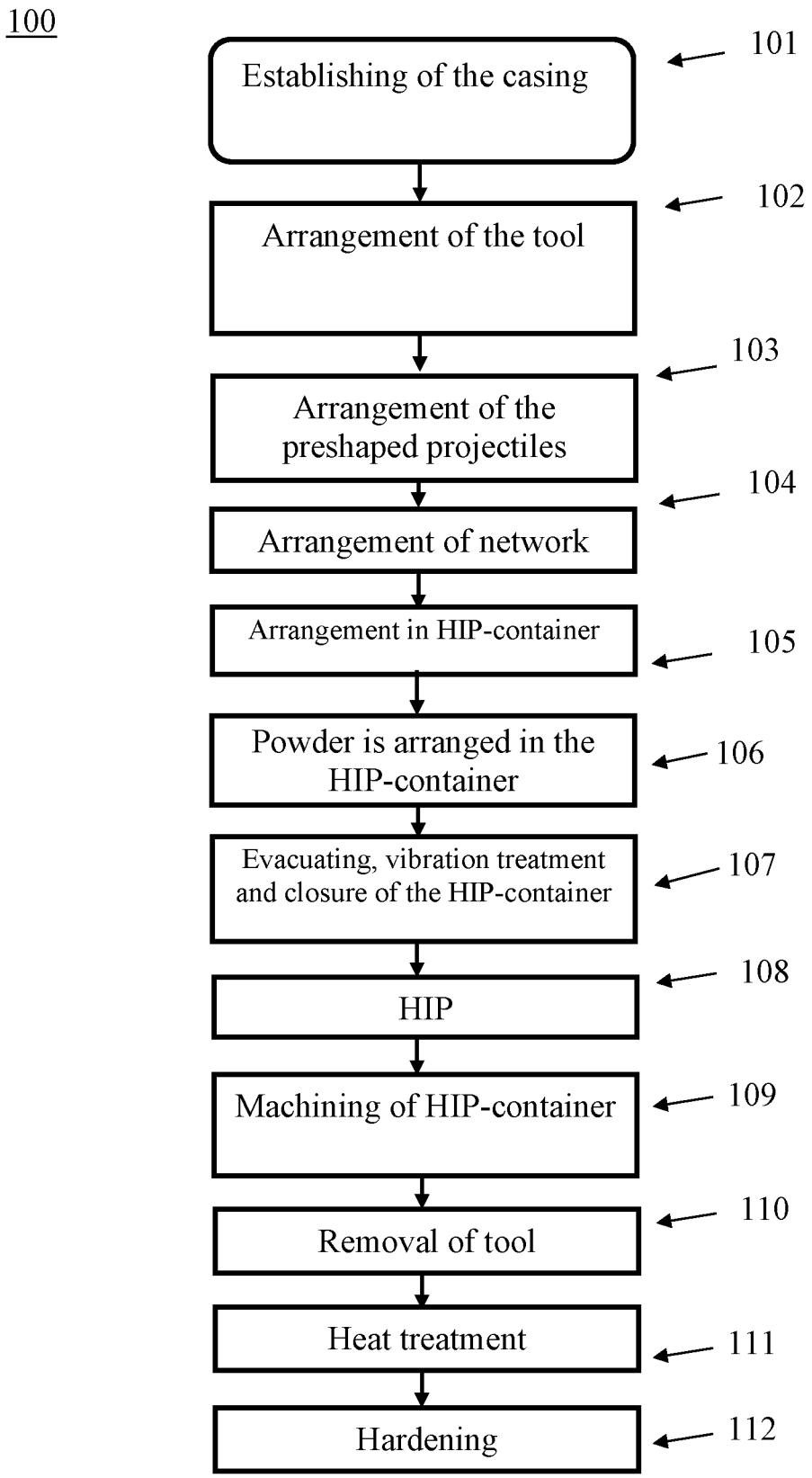
FIG. 5 shows the steps of the process of Hot Isostatic Pressing (HIP) when producing a warhead, in one embodiment of the invention

FIG. 5 shows a manufacturing method for a warhead 100. The casing for the warhead 4, the warhead also being known as the active part or grenade body, is produced by Establishing of the casing 101, for example by a cutting type machining such as lathe work, alternatively by additive manufacturing, but it can also be produced by pressing or drawing, for example. The casing can also be called the inner shell 1 and it may also be constituted by a spacer material. After the casing has been established, the step of Arrangement of the tool 102 occurs, which means that a tool 10 is arranged so that the casing encloses the tool. The geometry of the tool corresponds to the internal geometry of the inner shell/casing and thus to the internal geometry of the warhead. The geometry is preferably configured such that the tool can be removed after the manufacturing method 100 has been performed. After this, the preshaped projectiles 20 are arranged about the casing in the step Arrangement of preshaped projectiles 103. The preshaped projectiles 20 are retained by a network 5 in the step Arrangement of network 104. In one embodiment, the preshaped projectiles 20 and the network 5 are arranged at the same time around the inner shell/casing. The preshaped projectiles 20 are held in place by a network-like structure which is integrated with the warhead 4 during the performance of the manufacturing method 100. The inner shell 1 together with the preshaped projectiles 20 and the network 5 are arranged together in a HIP-container 30 in the step Arrangement in the HIP-container 105. A HIP-container 30 is an arrangement where powder is placed so that the powder is altered under high temperature and high pressure to form a HIPPED body. After the casing together with the preshaped projectiles and the network have been arranged together in a HIP-container 30, powder is arranged in the HIP-container 30 in the step Powder is arranged in the HIP-container 106. After the powder material is arranged in the HIP-container 30, the HIP-container 30 is evacuated, vibrated, and closed so as to evenly divide the powder in the HIP-container 30 in the step Evacuation, vibration treatment and closure of the HIP-container 107. After this, the HIP 108 is performed, that is, a gas is used to create an isostatic pressure in the HIP-container 30 by placing the gas in a connection device 31, 32 arranged on the HIP-container 30. Before the gas is placed in the HIP-container, the HIP-container can be vacuum pumped or otherwise evacuated of air or the filling gas/fluid arranged in the HIP-container 30 prior to the evacuation. At the same time, the entire HIP-container 30 is heated. The HIP-container and any surplus material is machined away in the step Machining of the HIP-container 109. After the HIPPED body has been machined, the tool can be removed from the casing in the step Removal of tool 110. After machining and removal of the casing has been done, the body can undergo heat treatment 111, which means that the now assembled body is heated. After heat treatment, the material is suitable for machining, such as a cutting type machining. After the tool has been removed, a hardening of the HIPPED body can occur in the step Hardening 112.

The invention is not limited to the specially presented embodiments but may be varied in different ways within the scope of the patent claims.

It is conceivable, for example, that the number of preshaped projectiles, the material choice, the choice of geometrical shapes, the elements and parts making up the warhead will be adapted according to the weapon system(s), platform, and other design attributes in the particular instance.

Moreover, all forms of warheads are covered, such as grenades containing projectiles, fragmentation grenades, guided missiles, missiles and rockets. Also other forms of warheads such as hand grenades and different types of mines.

The invention claimed is:

1. A method for producing a component for a warhead, comprising:

i.) arranging an inner shell on a tool, ii.) arranging preshaped projectiles on the inner shell in an enclosing network, iii.) arranging powder to enclose the preshaped projectiles, iv.) pressing the powder such that the powder, the preshaped projectiles, and the inner shell are joined together, v.) removing the tool from the component formed from the powder, the preshaped projectiles, and the inner shell, wherein the network is provided with holes sized to retain the preshaped projectiles when the network is arranged around the preshaped projectiles arranged on the inner shell, the preshaped projectiles having cross-sections larger than a size of the holes.

2. The method according to claim 1, wherein the powder is pressed by means of high pressure and heat, also known as Hot Isostatic Pressing (HIP).

3. The method according to claim 1, wherein the powder, the preshaped projectiles, and the inner shell are arranged together in a suitably adapted HIP-container.

4. The method according to claim 1, wherein the inner shell is a casing for a grenade body.

5. The method according to claim 1, wherein the inner shell is a spacer material.

6. A warhead produced by a method according to claim 1.

7. The warhead according to claim 6, comprising a projectile.

* * * * *